US005677719A

United States Patent [19]

Granzow

[11] Patent Number: 5,677,719

[45] Date of Patent: Oct. 14, 1997

[54] MULTIPLE PRINT HEAD INK JET PRINTER

[75] Inventor: Daniel B. Granzow, Spring, Tex.

[73] Assignee: Compaq Computer Corporation, Houston, Tex.

[21] Appl. No.: 594,781

[22] Filed: Jan. 31, 1996

Related U.S. Application Data

[63] Continuation of Ser. No. 127,165, Sep. 27, 1993, abandoned.

[51] Int. Cl.[6] ..... B41J 2/01

[52] U.S. Cl. ..... 347/103; 219/471; 347/37; 347/42; 492/46

[58] Field of Search ..... 347/103, 37; 219/216, 219/469–471; 492/46; 400/82

[56] References Cited

U.S. PATENT DOCUMENTS

| | | | |
|---|---|---|---|
| 3,167,166 | 1/1965 | Schiebeler | 400/82 |
| 3,471,683 | 10/1969 | Bogue | 219/469 |
| 4,204,779 | 5/1980 | Lee | 400/82 X |
| 4,208,666 | 6/1980 | Paranjpe | 347/40 X |
| 4,222,057 | 9/1980 | Cuvelier | 346/49 X |
| 4,223,323 | 9/1980 | Bader et al. | 347/39 |
| 4,520,368 | 5/1985 | Ims | 347/39 |
| 4,576,490 | 3/1986 | Isobe | 400/82 |
| 4,774,529 | 9/1988 | Paranjpe | 347/43 |
| 5,089,859 | 2/1992 | Landa et al. | 355/279 |
| 5,099,256 | 3/1992 | Anderson | 347/103 |
| 5,150,945 | 9/1992 | Drake | 347/42 |
| 5,201,590 | 4/1993 | Hakkaku | 400/82 X |
| 5,247,316 | 9/1993 | Komon et al. . | |
| 5,389,958 | 2/1995 | Bui et al. | 347/103 |
| 5,428,375 | 6/1995 | Simon | 347/37 X |
| 5,471,233 | 11/1995 | Okamoto | 347/103 |

FOREIGN PATENT DOCUMENTS

| | | | |
|---|---|---|---|
| 403190741 | 8/1991 | Japan | B41J 2/01 |
| 406064246 | 3/1994 | Japan | B41J 3/54 |

*Primary Examiner*—Joseph W. Hartary
*Attorney, Agent, or Firm*—Fish & Richardson P.C.

[57] ABSTRACT

An ink jet printer has multiple print heads for ejecting ink in response to signals supplied in sequence to cause ejection of ink in forming an image. The ink is ejected upon an ink transfer medium, and an energy source is adapted for application of heat to the surface of the ink transfer medium. A pressure application assembly places the printing substrate in contact with the ink transfer medium in forming an image by transfer of ink. Ejection of ink may occur from multiple ink jet print heads simultaneously.

11 Claims, 5 Drawing Sheets

MULTIPLE PRINT HEAD INK JET PRINTER

This is a continuation of application Ser. No. 08/127,165, filed Sep. 27, 1993, now abandoned.

BACKGROUND OF THE INVENTION

This invention is an improved apparatus and method of ink jet printing.

Print quality and speed are among the most important considerations in the design of a printing system. Ink jet printers can produce a relatively high quality image on paper or transparencies at relatively low cost. As the name implies, ink jet printers "jet" droplets of ink directly onto a substrate using a print head. There are two types of ink jet print heads, continuous stream and "drop-on-demand." Continuous stream heads eject ink continuously with the ink directed either to the paper or into a reservoir. The "drop on demand" print head intermittently ejects ink in response to electrical signals.

Typically, ink jet print heads are designed to scan the paper horizontally line-by-line. The paper is advanced in relation to the print head to position the paper for the next line. The mechanics of line-by-line printing necessarily limit the printing speed.

Printing speed also is limited by the fact that the ink must dry on the surface of the paper before the paper can be stacked or handled. To overcome this problem, drying systems are developed in conjunction with ink jet printers to dry the ink on the surface of the paper as quickly as possible.

The problem is compounded by the fact that most ink jet printers require an aqueous-based ink. Aqueous-based ink is nontoxic and allows low viscosity of the ink to facilitate jetting of the ink. However, evaporation of water for drying of aqueous ink requires more time and energy than would be required of other solvent systems.

Thus, it is apparent that the speed of drying is a limitation on the printing speed on ink jet printers. Such methods, as well as most other accelerated drying methods, require relatively high and inefficient heat input. Other methods have been proposed. In some, air is blown over the surface of the paper to assist in evaporating moisture. In others, document handling mechanisms are provided to separate the paper sheets while the ink drys on the surface of the paper and before the paper is actually stacked.

Moreover, ink jet printing generally causes noticeable deformation of the paper, referred to as "cockle" or curl of the paper. This is caused in part by the release of internal stresses within the paper fibers by the moisture from the ink and results in an undulating appearance to the paper. The curl is caused by drawing water onto the paper of a relatively low moisture content.

While curl can be somewhat controlled by the use of special paper, bond paper is preferred for most printing applications.

Conventional ink jet printing systems in which the print head is moved across the surface of a page by a carriage also may cause registration errors. A single ink jet print head that travels from the left to the right margin (6–8 inches) of the paper limits printing speed.

SUMMARY OF THE INVENTION

This invention provides greatly improved print speed and reliability by use of multiple print heads and a print transfer mechanism and method that overcomes the previous limitation on ink drying.

Improved printing and increased printing efficiency is accomplished by the use of multiple print heads that eject ink onto the cylindrical ink transfer medium for transferring the print to a printing substrate such as paper. The apparatus of the invention is capable of ejecting ink from print heads simultaneously, thereby increasing the efficiency of the printing.

In one aspect of the invention, the energy source for drying comprises an electrical resistance to heat the ink transfer medium.

Further, a method is provided in which ink is ejected from multiple print heads so that the distance traveled by each head is reduced by assignment of zones to each print head.

In one embodiment, heat is transferred to the surface of a cylinder by applying electrical signals to a resistive heating element placed near the inner surface of the cylinder and preferably with a thermal blanket to reduce heat loss to the cylinder interior.

DESCRIPTION OF THE PREFERRED EMBODIMENTS

Figure 1:
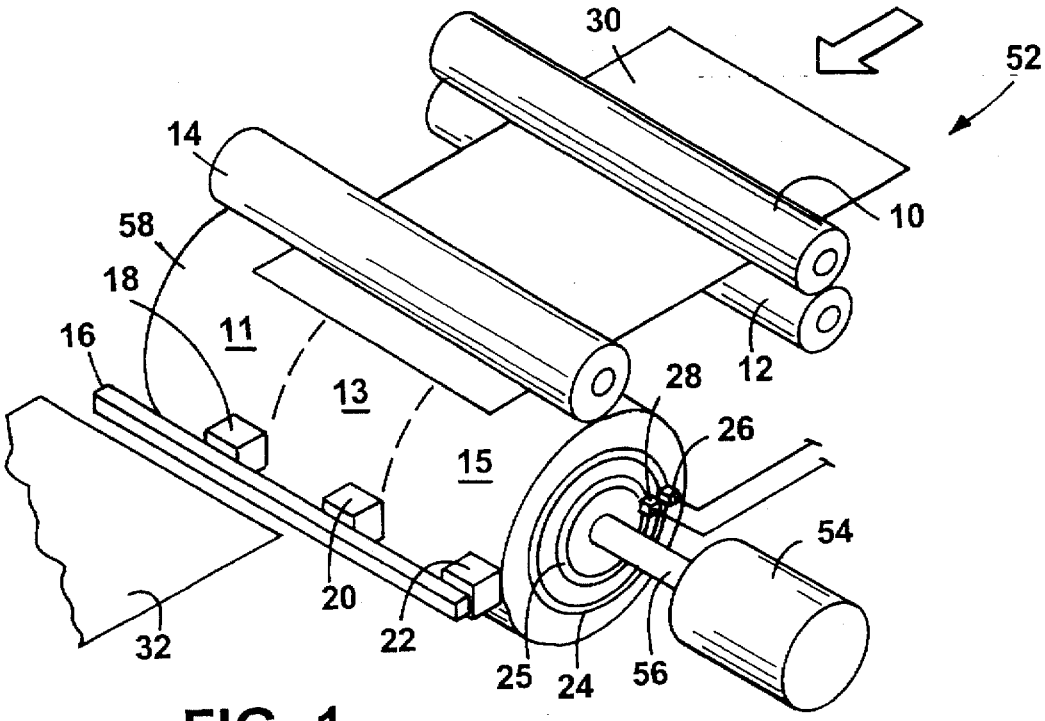
FIG. 1 is a perspective view of the improved ink jet printer showing multiple print heads arranged horizontally on a carriage.

Referring to FIG. 1, the printing mechanism 52 is comprised of several components. Drive unit 54 turns on its axis, rotating axle 56 which turns cylinder 58. Cylinder 58 is the ink transfer medium which receives ink ejected from ink jet print heads 18, 20, 22. Upper feed roller 10 and lower feed roller 12 operate in unison to feed paper 30, toward cylinder 58 in the direction indicated by the arrow in FIG. 1. In the operation, print head carriage 16 supports multiple print heads 18, 20, 22. In this embodiment, first print head 18, second print head 20, and third print head 22 are supported by print head carriage 16. First print head 18 prints upon print zone 11, second print head 20 upon print zone 13, and third print head 22 upon print zone 15, respectively. Each zone comprises about one-third of the available cylinder surface. Ink is ejected from the print heads onto the cylinder 58 during rotation of the cylinder from which the ink is transferred to the paper by the action of the transfer roller 14 pressing it against the surface of the cylinder. This ink transfer process is more fully explained by FIG. 4.

Heat is applied to the inner surface of the cylinder by an electrical heating element. The electrical contacts required to bring power into the heating element are shown as outer electrical contact 24 and inner electrical contact 25 on the end of the cylinder 58. These electrical contacts are concentric rings that receive electrical power from outer brush electrical contact 26 and inner brush electrical contact 28, respectively. As the cylinder rotates, they maintain a continuous electrical circuit by sliding across the surface of the concentric rings on the end of the cylindrical drum. Other electrical connections for supplying electricity to the heating element can be used.

Figure 2:
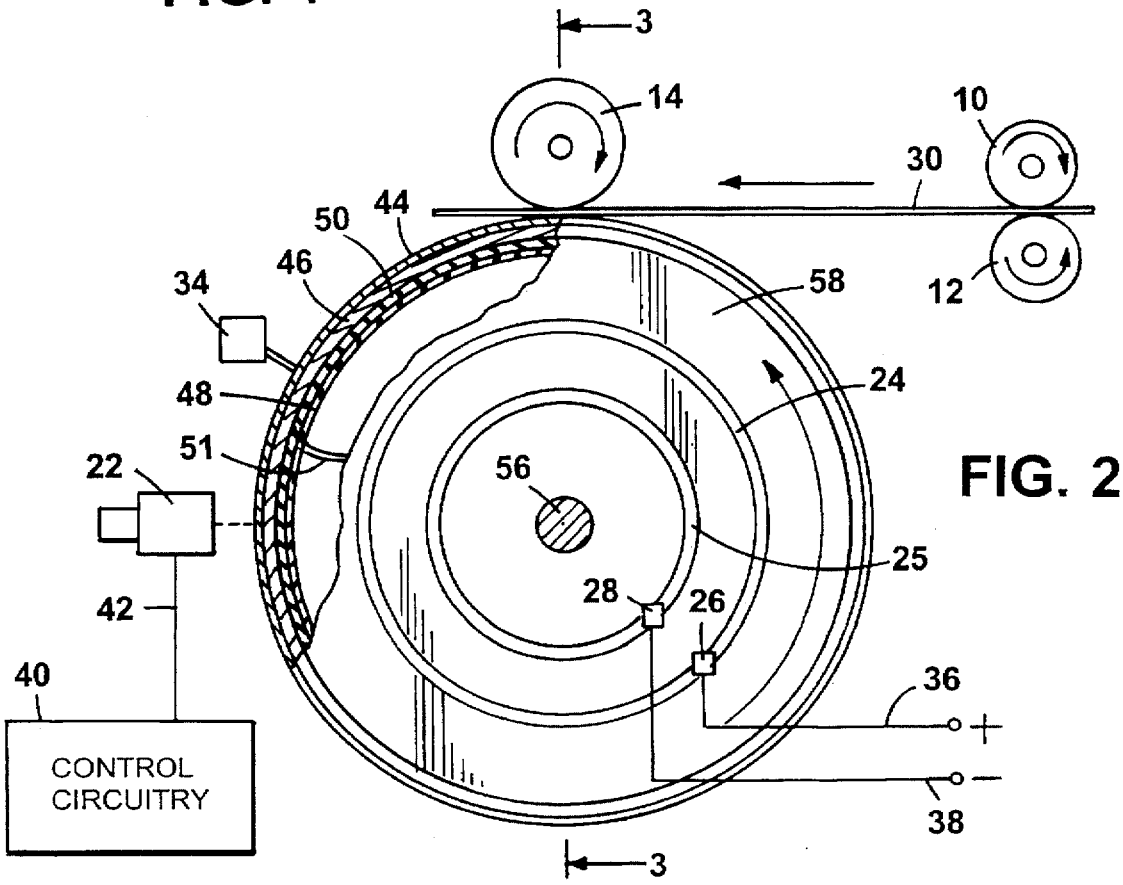
FIG. 2 is a cross-section of the cylinder shown in FIG. 1 showing a thermal blanket on the inside surface of the cylinder.

In FIG. 2, transfer roller 14 provides a frictional contact with the paper 30, to feed the paper across the surface of the cylinder 58. Upper feed roller 10 and lower feed roller 12 are seen at the upper right portion of FIG. 2.

In operation, cylinder 58 rotates about its axis in the direction shown by the arrow. Print head 22 ejects ink on zone 15 of the cylinder as directed by control circuitry (not shown). Electrical control circuitry is well known and readily specified by those skilled in the art.

As the cylinder 58 rotates, deposited ink (the printed image) moves around the periphery of the cylinder 58 approximately 270° counter-clockwise to a point near the top of FIG. 2 where it is transferred to the paper by the action of transfer roller 14. A drum wiper 34 is shown in the upper left portion of FIG. 2, and serves to clean the cylinder 58 after transfer of ink to the paper, preparing the surface for another cycle. A cut-away view of the cylinder 58 shows the coating 44 on the surface of the cylinder wall 46 and the thermal blanket 48 at the inner surface of the cylinder wall 46.

Electrical power is supplied to the heating element of the thermal blanket by electrical lead 51. The heated cylinder 58 accelerates evaporation of moisture from the ink as it travels. Electrical leads 36 and 38 provide electricity to the outer brush contact 26 and inner brush contact 28. Axle 56 forms the axis of rotation about which the cylinder 58 rotates.

Figure 3:
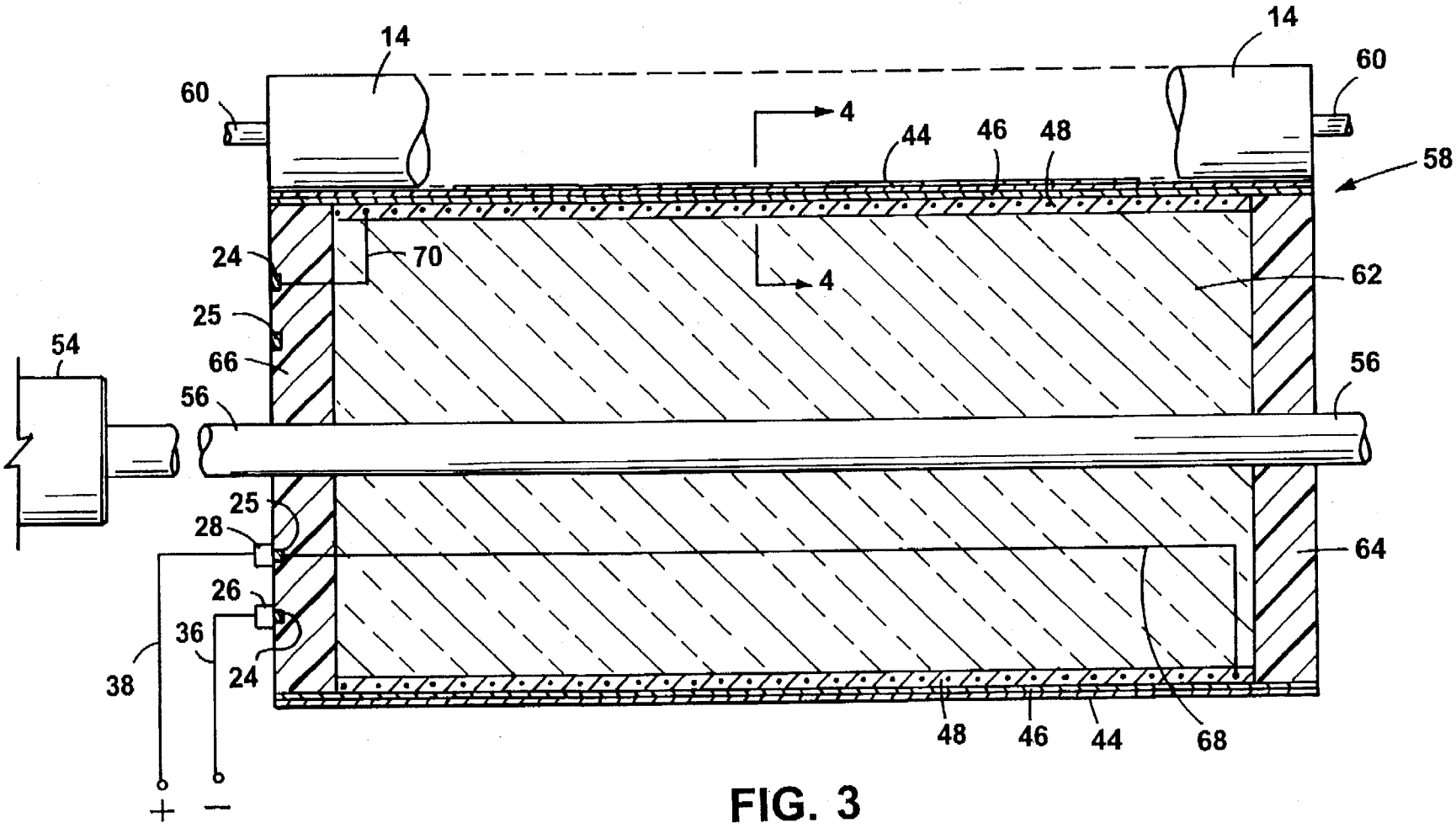
FIG. 3 is a view of section 3—3 of FIG. 2.

In FIG. 3, the axle 56 is seen along the mid-line of the cylinder 58, where it protrudes from the left insulating end cap 66 and right insulating end cap 64, located at opposite ends of the cylinder. The insulating end caps 64–66 prevent loss of heat through the ends of the cylinder 58, resulting in a more efficient power use.

Polyamides, polyesters, and polyvinyl chloride which have sufficiently high melting points and transition temperature are suitable for use as a cylinder surface coating material. The surface of the cylinder 58 is coated with a coating 44 which easily releases dried ink. Hydrophobic (water rejecting) polymers make very suitable coatings. Tetrafluoroethtylene fluorocarbon polymers, e.g., TEFLON (a trademark of the E. I. DuPont de Nemours Company) is preferred. Any coating that provides a suitable hydrophobic surface that facilitates the effective transfer of ink can be used. Beneath the coating 44 is the cylinder wall 46. The cylinder 58 is preferably metallic and may be comprised of polished aluminum, copper, or other metal. Nonmetallic materials may also be used. In some cases, the surface of the cylinder 58 may be coated with silicone oil or another lubricating substance to facilitate transfer of the ink in forming an image.

Below the cylinder wall 46 is thermal blanket 48, which is seen in cross section at the upper and lower portions of FIG. 3. The thermal blanket 48 contains an electrical heating element 50. Electrical power is supplied to the resistive heating element 50 through electrical lead 68, and inner brush electrical contact 28. Electrical lead 38 provides power to inner brush electrical contact 28. Further, electrical lead 36 provides power to outer brush electrical contact 26. The outer electrical contact 24 and the inner electrical contact 25 are embedded in the left insulating end cap 66. The interior of the cylinder 58 contains insulation 62 that inhibits the heat loss from the cylinder 58. Transfer roller 14 provides a frictional force upon the paper in transferring the ink from the cylinder 58 to the paper 30. Drive unit 54 rotates axle 56.

Figure 4:
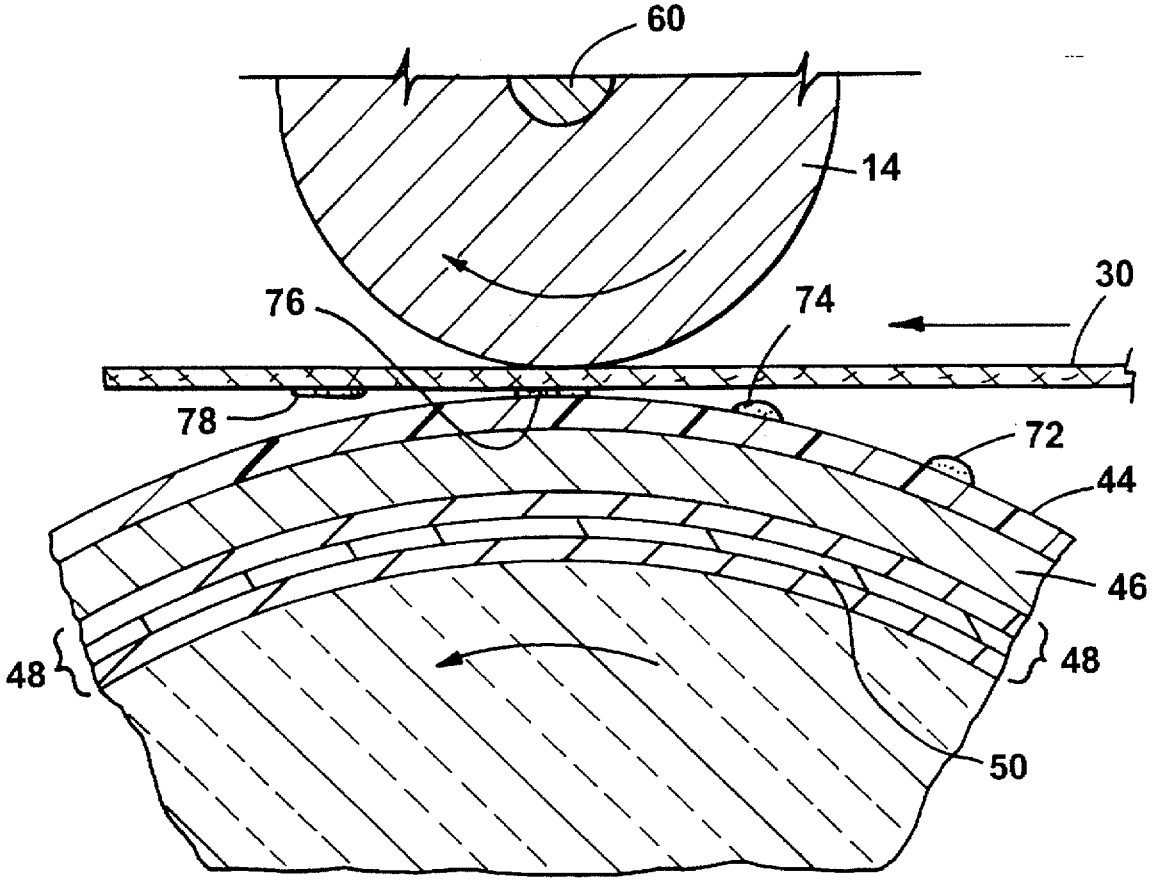
FIG. 4 is a sectional view of the outer surface of the cylinder of FIG. 3.

FIG. 4 shows a detailed sectional view along lines 4—4 of FIG. 3. Transfer roller 14 is seen at the top of FIG. 4. An expanded view of the thermal blanket 48 shows it upon the inner surface of the cylinder wall 46. The thermal blanket 48 contains heating element 50. The thermal blanket 48 is comprised of an elastomeric material in which the heating element 50 is embedded. The preferred elastomeric material is silicone rubber, but other materials could be used.

As the ink droplet 72 moves around the cylinder 58 towards the blank paper, water is evaporated, causing the droplet to shrink somewhat in size, and to pucker around its edges, forming a sharply defined and clear image when transferred to the paper 50. A substantially dried ink droplet 74 is seen in FIG. 4 just prior to the time that it is transferred to the paper 30. Ink droplet 76 is seen undergoing transfer to the paper 30, while a transferred ink image 78 is seen in FIG. 4 proceeding in a right-to-left direction on the surface of the paper 30.

Heat is transferred to the cylinder wall 46, and through coating 44 to ink droplet 72 (which previously was deposited upon the surface of the coating).

In this invention, heat is supplied to the ink droplets 72 as each droplet 72 proceeds in a circular path on the surface of the cylinder 58. Prior to the time that the ink droplet 72 transfers to the paper, sufficient moisture should be evaporated from the droplet to effect a clear and precise transfer. The formation of a molten polymer of ink by heating is the most desirable method of effecting a transfer. It has been found that a thermal blanket 48 is the most efficient and effective method of transferring energy to the droplet 72 in evaporating moisture, to produce a sharply defined image on the paper. Other methods heating the surface of the cylinder 58 may be used, and this invention is not limited to any particular method, although the preferred method is to use a thermal blanket 48.

Figure 5:
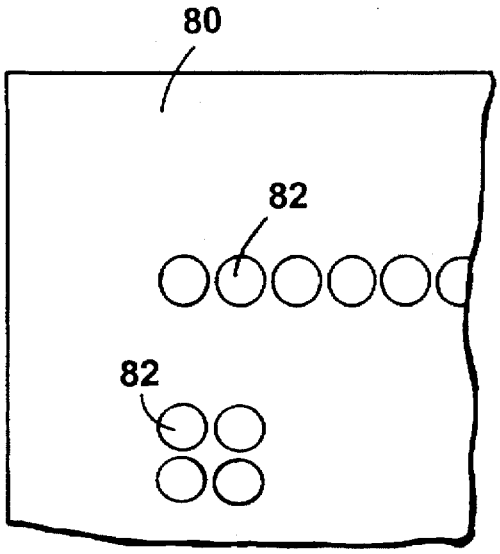
FIG. 5 depicts an example of printing accomplished with this invention, wherein the ink droplets have been applied to the paper in a clean transfer.

In FIG. 5, a greatly magnified view of a paper surface 80 on which the ink droplets 52 were sprayed upon the surface of the drum and transferred to the paper 80 is shown. Droplets 82 were transferred to the paper after appropriate drying and result in a clean image transfer. Appropriate drying is a function of the temperature and time the droplet 82 remains on the surface of the drum cylinder 58.

Of course, the drying time depends upon the speed of rotation of the cylinder 58. The thermal blanket 48 provides a suitably efficient transfer of heat energy to the ink droplets such that the moisture may be evaporated in three seconds or less. At three seconds, the speed of the cylinder 58 can be at least 20 revolutions per minute, and depending upon the size of the cylinder, may translate into a printing speed of at least 20 pages per minute.

Figure 6:
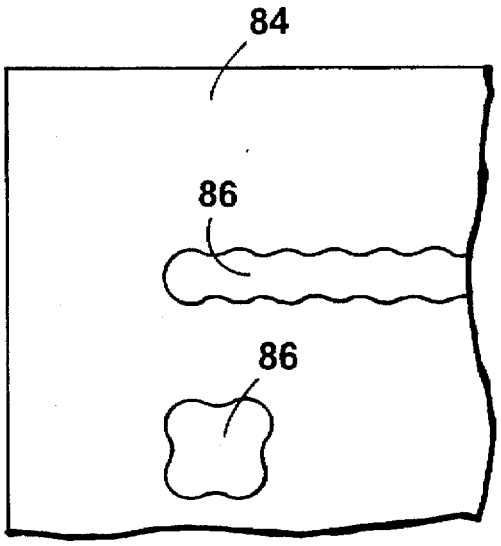
FIG. 6 depicts an example of an inferior transfer, wherein the water was not fully evaporated from the ink prior to transfer to the paper, resulting in a blurred image.

FIG. 6 shows a magnified view of a paper surface 84 with a blurred image 86 caused by transfer of ink that was insufficiently dried.

Figure 7:
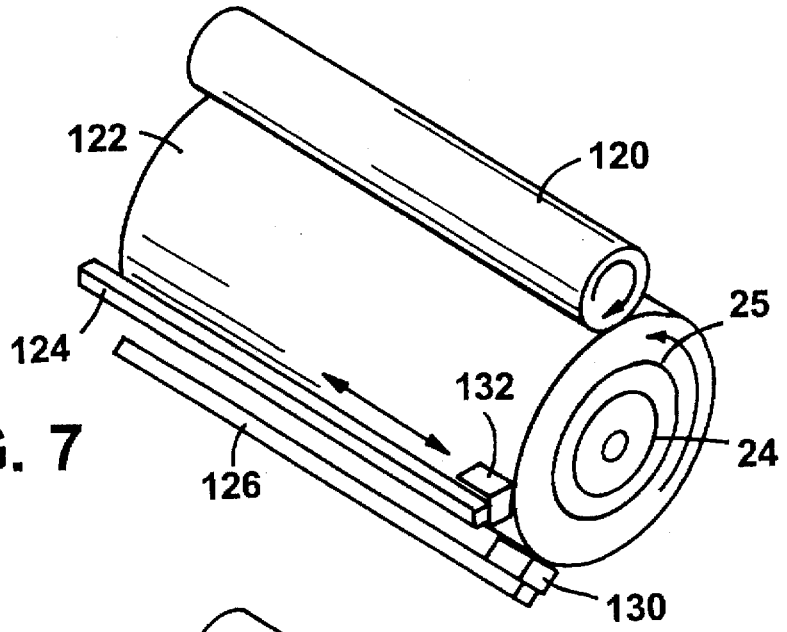
FIG. 7 shows an alternate embodiment of the invention, with two carriages placed in parallel, with one print head on each carriage.

In FIG. 7, an alternate embodiment of the printing mechanism 52 is shown. The print head apparatus comprises an upper print head carriage 124 and a lower print head carriage 126. These two carriages each contain a single print head 130, 132 that travels the length of the cylinder 122, across the entire "page" width of the transfer cylinder 122.

For purposes of discussion, this specification will refer to "page", although it is understood that the print heads are spraying ink upon the ink transfer medium or cylinder, not upon a paper or "page". The ink is transferred to a paper or other medium at a later step.

Using this printing arrangement, an upper print head 132 travels the length of the upper print head carriage 124, while a lower print head 130 travels the length of the lower print head carriage 126. In the printing on the surface of the cylinder 122, the upper print head 130 may be used to print the bottom half of a page, for example, and the lower print head 132 simultaneously may be used to print the upper half of the same page. In this way, two print heads may be simultaneously printing a part of the same page of information upon the surface of the drum, doubling the printing speed.

In other respects, the embodiment shown in FIG. 7 is similar to that shown in FIG. 1. That is, a transfer roller 120 provides pressure to transfer the image onto the paper, in conjunction with the cylinder 122. Likewise, the inner electrical contact 25 and outer electrical contact 24 may be seen on the end of the cylinder 122 in FIGS. 7, 7A, 7B, 7C and 8.

Figure 7A:
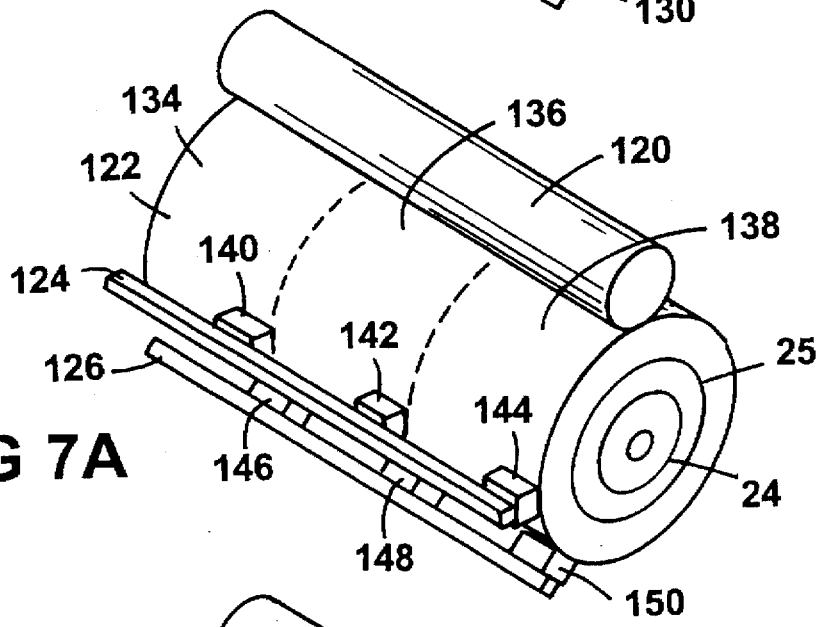
FIG. 7A is another alternate arrangement with two parallel carriages, each carriage having multiple print heads for printing upon a defined zone of the cylinder.

FIG. 7A shows an alternate embodiment of the printing mechanism in which an upper print head carriage 124 and a lower print head carriage 126 each contain multiple print heads. The upper print head carriage 124 comprises first print head 140, second print head 142, and third print head 144. Each of these print heads applies ink in first zone 134, second zone 136, and third zone 138 of the cylinder 122, respectively.

The lower print head carriage 126 likewise contains multiple print heads; fourth print head 146, fifth print head 148, and sixth print head 150. Each of these three print heads also print in first zone 134, second zone 136, and third zone 138 of the cylinder 122.

In the embodiment shown in FIG. 7A, very rapid printing is obtained. For example, a single "page" or image may be divided into six portions, three at the top half of the "page" and three at the bottom half of the "page". Using six print heads, as seen in FIG. 7A, would facilitate the simultaneous printing of six portions of one page at one time, allowing for a rapid completion of the single page image, further increasing the speed of the printing obtained using the printing apparatus.

Of course, the number, arrangement, and type of print heads used in this invention will be dictated by costs. In some cases, it may be cost prohibitive to use six or more print heads, depending upon the speed of printing that is required in that particular application. This invention is not limited to any particular number of print heads.

Figure 7B:
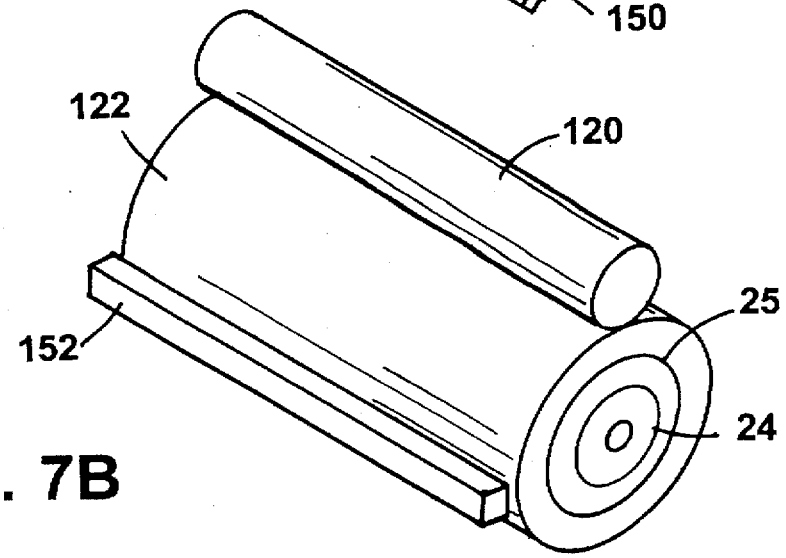
FIG. 7B shows a full width print head.

FIG. 7B shows a full width print head 152 that requires no horizontal travel of the printing apparatus. The print head jets extend across the full width of the page.

Figure 7C:
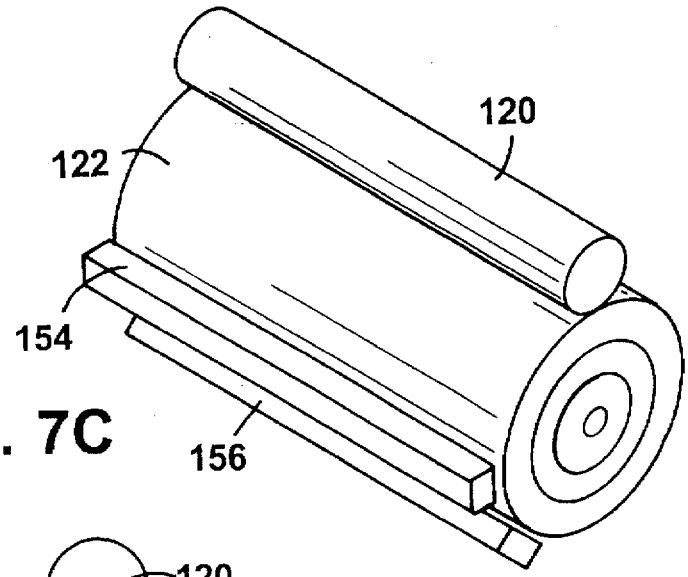
FIG. 7C shows multiple full width print heads.

FIG. 7C is an alternate embodiment with two full width print heads, an upper print head 154 and a lower print head 156. In this application, the page is printed in an upper half and lower half simultaneously, except that there is no horizontal travel of the print heads. The bottom half of the page is printed by the upper full width print head 154, while the top half of the page or image is printed by the lower full width print head 156, simultaneously. This application is most effective to prevent registration errors.

In describing this invention, three print heads on each carriage have been shown but any number of print heads greater than two may be used. Likewise, the number of zones upon which the print heads are assigned may be as little as two or as many as desired. Of course, there is a point at which the number of print heads, and zones corresponding to the print heads, is so great that the cost of the extra print heads is not outweighed by the speed which is achieved by the addition of the print heads.

Figure 8:
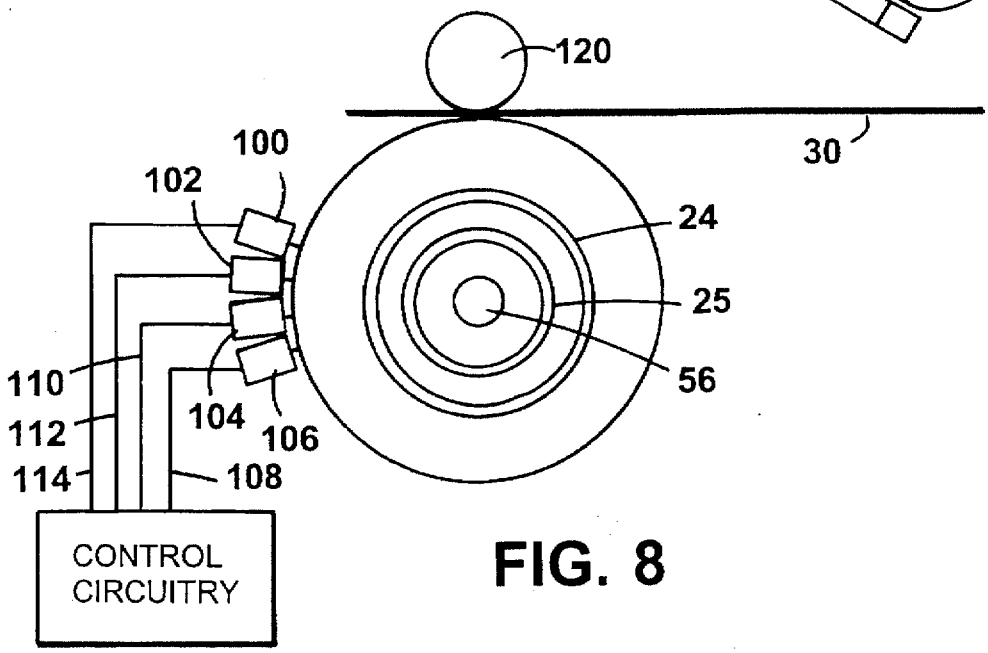
FIG. 8 shows a color ink jet printing system of this invention.

FIG. 8 depicts an alternate embodiment of this invention for color printing. Ink is applied to the cylinder using multiple ink jets in a color format. In this embodiment, four separate ink jets are used to provide the primary ingredients which, when mixed, provide color printing. The magenta ink jet 100, the cyan ink jet 102, the yellow ink jet 104, and the black ink jet 106 provide an ink jet print head which is assigned to one particular zone along the cylinder, and other ink print heads could be utilized along the length of the cylinder drum. In this way, color printing may be provided to effect the efficient printing characteristics of this invention. Control circuitry provides electrical signals to electrical lead 108, electrical lead 110, electrical lead 112, and electrical lead 114 to direct the proper ejection of ink in forming the color image upon the surface of the cylinder. As in the other embodiments described, blank paper 30 is used, and outer electrical contact 24 and inner electrical contact 25 provide electrical signals to the cylinders. Further, the axle 56 is in the center of the cylinder, as shown in FIG. 8.

In an alternate embodiment, color printing is achieved by an overlay method. The cylinder would not provide a color image for transfer to the paper on each turn of the cylinder, but instead color is applied during one rotation. Another color is applied on the next rotation. In this way, layers are formed on the surface of the cylinder. This layering effect provides printing characteristics not achieved in prior art printers.

Figure 9:
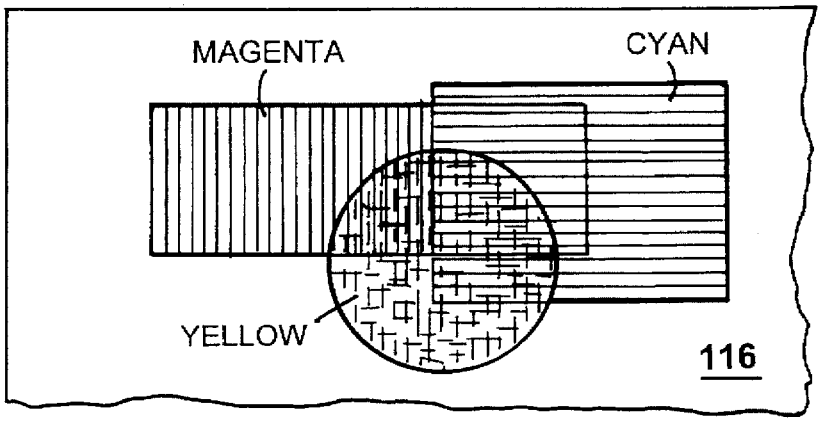
FIG. 9 shows an optional feature of this invention which includes color printing using an overlay technique.

FIG. 9 shows color printing in which the cyan, magenta and yellow colors are overlayed. This overlay could be accomplished in a plurality of rotations of the cylinder, to provide a translucent coloring effect using this invention. Once the cylinder has rotated a sufficient number of times to receive the color ink forming the translucent effect, the image could be transferred to the paper 116.

Other embodiments are within the scope of the following claims.

What is claimed is:

1. An ink jet printer comprising:

(a) ink jet print heads for ejecting ink;

(b) a print head support along which said print heads travel;

(c) an ink transfer medium onto which said print heads eject ink along a transfer width of said ink transfer medium that corresponds to a print width of a single printing substrate, said print heads being controlled to eject ink simultaneously along respectively different portions of said transfer width, said ink transfer medium comprising a cylinder having an interior and an exterior surface, said cylinder closed at each end by an insulating cap, one of said insulating caps including a pair of concentrically arranged electrical contacts;

(d) an electric heating element embedded in an insulating material coupled to said interior surface, said electric heating element electrically connected to said concentrically arranged electrical contacts;

(e) an electrical power connection including a pair of brush contacts operatively coupled to said concentrically arranged electrical contacts for supplying power to said heating element;

(f) a hydrophobic coating coupled to said exterior surface; and (g) an image transfer assembly operatively coupled to said ink transfer medium to transfer ink from said hydrophobic coating to said printing substrate.

2. The printer of claim 1, wherein said insulating material comprises an elastomeric material.

3. The printer of claim 2, wherein said elastomeric material comprises silicone rubber.

4. The printer of claim 1, wherein said hydrophobic coating comprises a tetrafluoroethylene fluorocarbon polymer.

5. The printer of claim 1, wherein said hydrophobic coating comprises silicone oil.

6. An ink jet printer, comprising:

print head supports along which print heads travel;

ink jet print heads coupled to said supports so that two of said print heads are coupled to each one of said supports, said print heads being controlled to eject ink simultaneously along respectively different portions of a transfer width of an ink transfer medium that corresponds to a print width of a single printing substrate, said ink transfer medium comprising a cylinder having an interior and an exterior surface, said cylinder closed at each end by an insulating cap, one of said insulating caps including a pair of concentrically arranged electrical contacts;

an electric heating element embedded in an insulating material coupled to said interior surface, said electric heating element electrically connected to said concentrically arranged electrical contacts;

an electrical power connection including a pair of brush contacts operatively coupled to said concentrically arranged electrical contacts for supplying power to said heating element;

a hydrophobic coating coupled to said exterior surface; and an image transfer assembly operatively coupled to said ink transfer medium to transfer ink from said hydrophobic coating to said printing substrate.

7. An ink jet printer, comprising:

print head supports;

page width print heads each coupled to one of said print head supports;

an ink transfer medium onto which said print heads eject ink onto transfer widths of said ink transfer medium that corresponds to print widths of a single printing substrate, said print heads being controlled to eject ink simultaneously onto respectively different transfer widths of said ink transfer medium, said ink transfer medium comprising a cylinder having an interior and an exterior surface, said cylinder closed at each end by an insulating cap, one of said insulating caps including a pair of concentrically arranged electrical contacts;

an electric heating element embedded in an insulating material coupled to said interior surface, said electric heating element electrically connected to said concentrically arranged electrical contacts;

an electrical power connection including a pair of brush contacts operatively coupled to said concentrically arranged electrical contacts for supplying power to said heating element;

a hydrophobic coating coupled to said exterior surface; and an image transfer assembly operatively coupled to said ink transfer medium to transfer ink from said hydrophobic coating to said printing substrate.

8. The printer of claim 7, wherein said insulating material comprises an elastomeric material.

9. The printer of claim 8, wherein said elastomeric material comprises silicone rubber.

10. The printer of claim 7, wherein said hydrophobic coating comprises a tetrafluoroethylene fluorocarbon polymer.

11. The printer of claim 7, wherein said hydrophobic coating comprises silicone oil.

* * * * *